US005437233A

United States Patent [19]

Richter

[11] Patent Number: 5,437,233

[45] Date of Patent: Aug. 1, 1995

[54] RAIL-CLEANING LOCOMOTIVE

[75] Inventor: Wolfgang Richter, Nürnberg, Germany

[73] Assignee: Ernst Paul Lehmann Patentwerk, Nuernberg, Germany

[21] Appl. No.: 190,823

[22] Filed: Feb. 2, 1994

[30] Foreign Application Priority Data

Feb. 3, 1993 [DE] Germany ..... 9301455 U

[51] Int. Cl.[6] ..... B61F 19/00

[52] U.S. Cl. ..... 104/279; 15/55

[58] Field of Search ..... 446/447, 467; 104/279; 15/55, 54

[56] References Cited

U.S. PATENT DOCUMENTS 2,475,771 7/1949 Wittner ..... 104/279
2,719,312 10/1955 Hyland ..... 15/55
3,789,768 2/1974 Broz ..... 104/279
4,101,014 7/1978 Matheson ..... 104/279 X
5,060,335 10/1991 Webster ..... 15/97.1

*Primary Examiner*—Mickey Yu
*Attorney, Agent, or Firm*—Jordan and Hamburg

[57] ABSTRACT

A rail-cleaning locomotive for electrical toy and model trains with a cleaning unit including polishing disks rotated by an electric motor and lying on the rails, wherein the cleaning unit is disposed in a fore-part, coupled to the locomotive so that it can pivot about a vertical and slightly also about a horizontal axis, and is provided with a cleaning motor, which is separated from the driving motor of the locomotive, and wherein the polishing disks are constructed as cleaning wheels with guiding wheel flanges.

19 Claims, 4 Drawing Sheets

RAIL-CLEANING LOCOMOTIVE

BACKGROUND OF THE INVENTION

The invention relates to a rail-cleaning locomotive for electrical toy and model trains with a cleaning unit, comprising polishing disks rotated by an electric motor and lying on the rails.

Such rail-cleaning locomotives for cleaning the rails and, with that, primarily for ensuring good electrical contact between the current-carrying rails and the current collectors of a vehicle driving thereon have already been proposed in various embodiments. Aside from arrangements, which provide clean grinding blocks dragging over the rails, constructions of the initially-described type have also already become known, for which electrically driven polishing disks or polishing rollers are driven, which must be constructed significantly wider than the rails, so that they do not lose contact with the rail even when taking curves. For one such rail-cleaning apparatus described in the German Offenlegungsschrift 26 25 582, the grinding or polishing rollers obtain their driving power from the driving motor of the locomotive. This, however, creates considerable difficulties in practice. For example, if there are variations in the driving speed of the rail-cleaning locomotive, there is also a change in the grinding performance, which is troublesome to a very high degree. In addition, especially when a high grinding performance is desired, the driving speed would also be correspondingly higher which, in turn, contributes to the fact that the power in the grinding rollers is not fully utilized since, because of the high speed, intensive cleaning of the rail surfaces cannot take place. It is equally undesirable that, due to the elastic contact between the grinding rollers and the rail surfaces, the locomotive is lifted by the impact point of the grinding rollers, which at the very least contributes to the fact that a lesser contacting pressure is available for the running wheels, which is also very burdensome.

A rail-cleaning car, which is proposed in the German Utility Patent G 86 31 074.7 and inserted in a train without its own driving mechanism, can also not provide a satisfactory remedy for the problems above. The grinding or polishing rollers are disposed together with their own driving motor in a part suspended elastically in the car between the wheel axes. Here also, the difficulty arises that, on the one hand, a high driving power for the cleaning motor is required. However, because the supply voltage is supplied over the rail, this leads in turn to a simultaneous effect on the speed of the locomotive which, when the locomotive and the cleaning unit are separated by the installation of the cleaning unit in a separate, subsequent car, causes very appreciable coordination problems.

Finally, a further rail-cleaning car has also already been proposed in the German Utility Patent G 83 14 477.3, for which the cleaning brushes, in conjunction with vacuum cleaners disposed behind them, can completely remove the dust brushed off from the rail. However, such brushing apparatuses are unsuitable for a good contact with the rail, since they cannot remove smudges such as fat and abraded rubber from the rail surfaces. In other respects, the same difficulties are associated with the arrangement of this Utility Patent as with those already described with respect to the Utility Patent G 86 31 074.7.

SUMMARY OF THE INVENTION

It is therefore an object of the invention to configure a rail-cleaning locomotive of the initially-named type in such a way that, with a simple, robust construction, cleaning of the rails with simultaneous adjustability of the cleaning intensity is possible under all conceivable operating conditions, even in the case of weatherproof rails set down in the garden.

Pursuant to the invention, this objective is accomplished owing to the fact that the cleaning unit is disposed in a fore-part of the locomotive, coupled to the locomotive so that it can pivot about a vertical and slightly also about a horizontal axis, and is provided with a cleaning motor, which is separated from the driving motor of the locomotive, and that the polishing disks are constructed as cleaning wheels with guiding wheel flanges.

The inventive construction results in a rail-cleaning locomotive for which, in contrast to all previously described rail-cleaning vehicles, wide polishing rollers, which are shifted laterally over the rails in curves, are not provided. Instead, grinding wheels with a narrow contacting surface corresponding to the driving wheels of the locomotive are provided since, due to the provision of wheel flanges in conjunction with the mobility of the fore-part of the locomotive containing the cleaning unit, an independent swiveling of the fore-part can take place in the curves. For example, and this has proven to be particularly advantageous in practice, the whole of the driving voltage at the rails can be applied, in order to drive the cleaning motor of the cleaning unit with this high, full driving voltage, while the driving speed of the driving motor is changed by separate control elements, preferably mounted on the locomotive itself. It is self-evident that, with this type of operation, further vehicles cannot drive on the arrangement during the run of the rail-cleaning locomotive, unless it is a question of vehicles, the motor of which can be controlled by remote control even when it is supplied with a fixed, high driving voltage.

An adjusting knob, which controls the driving speed at a constantly full driving voltage for operating the cleaning motor and is disposed under a detachable covering, is therefore preferably disposed on an inventive rail-cleaning locomotive.

In a further development of the invention, a function switch with three positions can be provided. In these positions, the locomotive alternately is switched off by being currentless, drives (and, moreover, forwards or backwards depending on the polarity of the vehicle voltage) with the cleaning motor switched off in the second position, or finally, in the third function position, drives forward with the cleaning fore-part in front and the cleaning motor operating or, when the driving voltage is reversed, drives backwards with the cleaning fore-part trailing, in this case, however with the cleaning motor switched off.

As is already the case for the construction of the inventive rail-cleaning locomotive, the arrangement should in any case be such for an inventive rail-cleaning locomotive that the cleaning wheels are rotated in the opposite direction to the driving wheels, since a particularly intensive cleaning is possible in this way. Furthermore, it is avoided that the cleaning wheels act as driving wheels and intensify the drive of the driving wheels with a corresponding weakening of the cleaning effect.

In a refinement of the invention, the inventive cleaning wheels can in each case comprise a wheel flange disk with supporting ring for an exchangeable cleaning ring as well as a holding disk, which can be braced against the wheel flange disk by means of an axle bolt, thus clamping the cleaning ring. This makes it possible to dismantle the assembly very easily and to exchange the cleaning wheels easily, so that it is not necessary to exchange the whole of the cleaning roller when the polishing surface is worn away, as must be done for the rail-cleaning vehicles previously known. It is therefore only necessary to loosen the axle bolt in order to be able to remove the cleaning ring and replace it by a new cleaning ring. Because it is so easy to exchange the cleaning rings, it is also possible to use appropriate cleaning rings with different ranges of grain sizes depending on the degree of contamination of the rails.

In order to be able to utilize the rotation of the cleaning wheels effectively for the cleaning, polishing or grinding of the rail surface, a loading weight can be provided in the cleaning fore-part. This loading weight does not affect in any way the contacting force of the driving wheels of the locomotive, since the fore-part of the locomotive, containing the cleaning unit, is suspended, as it were, on gimbals on the remaining part of the locomotive. In this connection, it is self-evident that the loading weight is selected so that the cleaning unit as a whole is lighter than the actual driving part of the locomotive, as otherwise the advance against the braking force of the oppositely rotating cleaning wheels could not be guaranteed practically.

A thermal overload switch for protecting the cleaning motor can be installed, to advantage, in the cleaning locomotive.

Finally, it is also within the scope of the invention to provide flashing lights, which are coupled in their function with the operation of the cleaning motor, so that, when the inventive rail-cleaning locomotive is being run, it can be seen from the outside by the flashing of the flashing lights whether the rails are being cleaned at the same time or not whether or the locomotive is running with the cleaning unit switched off.

Further advantages, characteristics and details of the invention arise out of the following description of an embodiment, as well as from the accompanying drawings.

DESCRIPTION OF THE PREFERRED EMBODIMENTS

Figure 1:
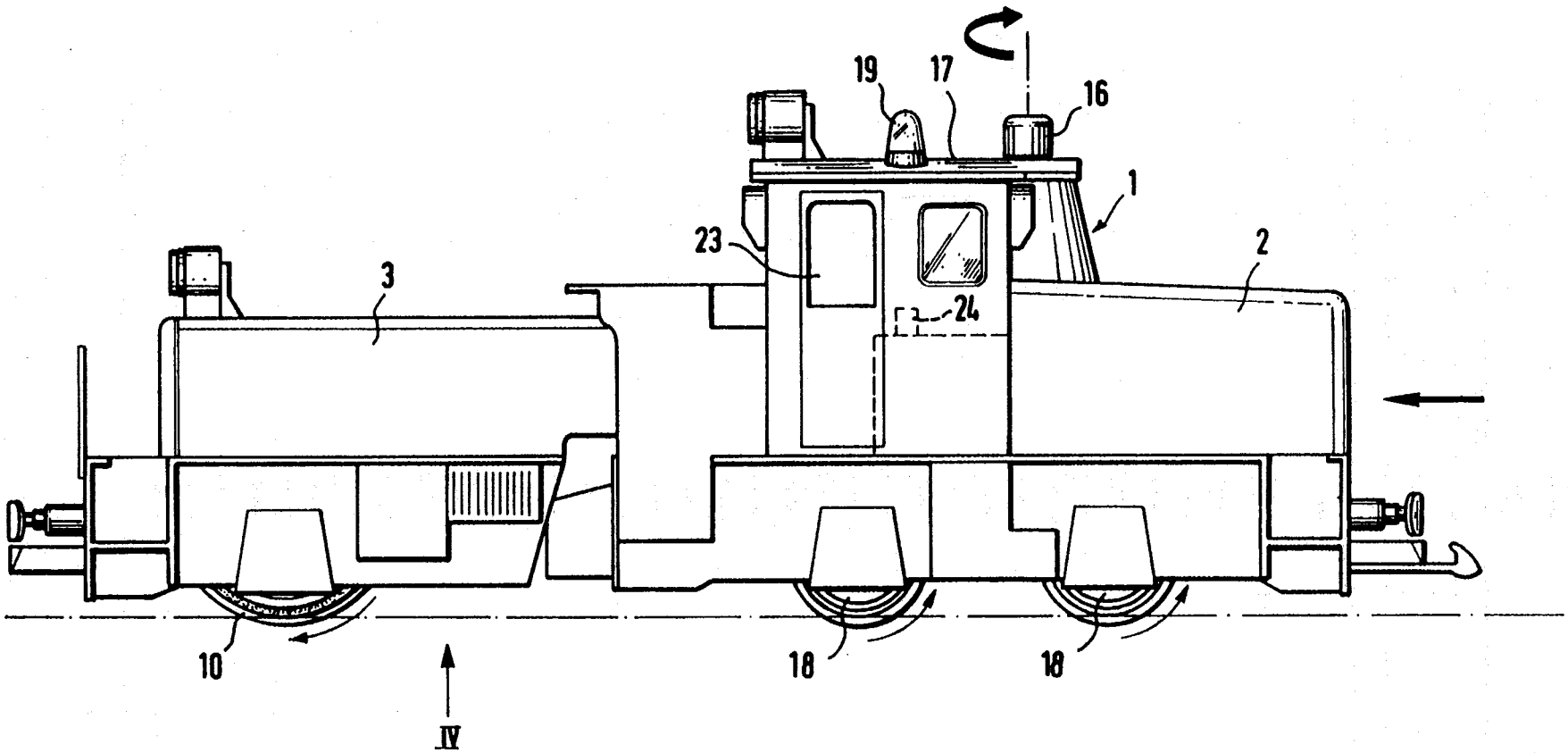
FIG. 1 shows a side view of an inventive cleaning locomotive.
Figure 2:
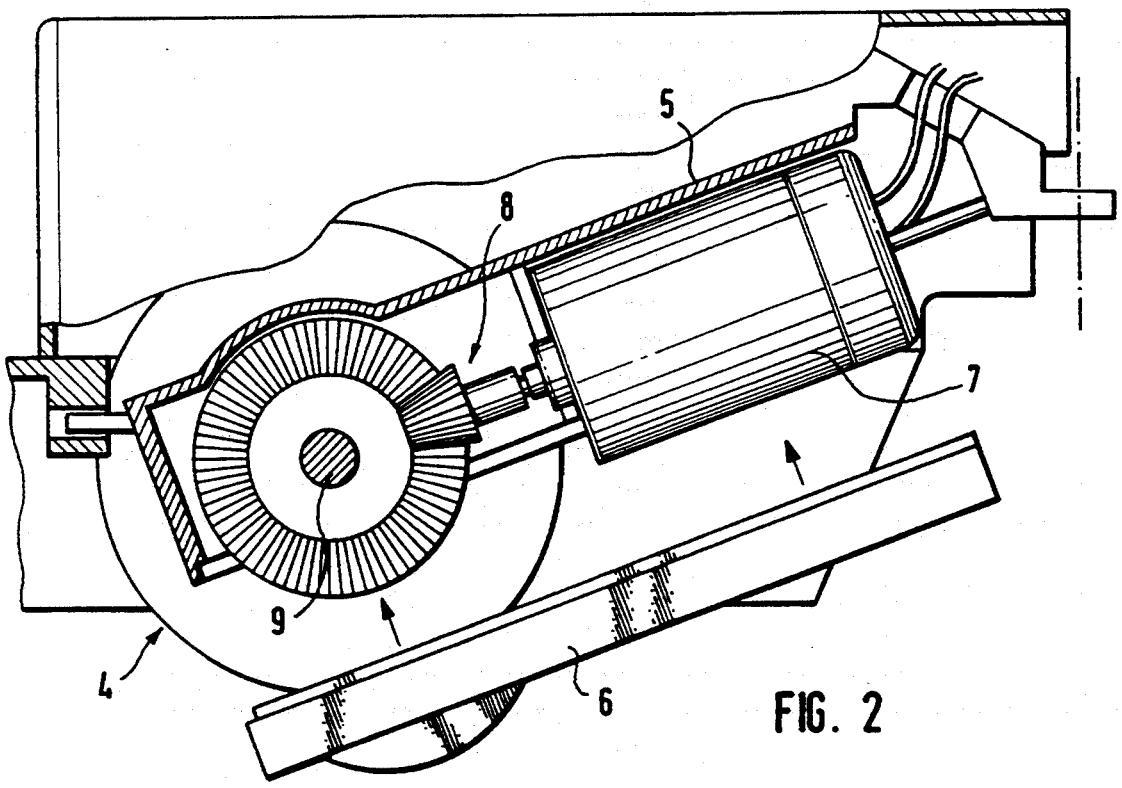
FIG. 2 shows an enlarged, partially sectional side view of the locomotive fore-part, containing the cleaning unit.

The rail-cleaning locomotive 1, shown in the Figures, comprises a rigid, shorter fore-part 2 and a longer fore-part 3, which is pivotably hinged thereto about a vertical axis and, in addition, also at least to a slight extent about a horizontal axis. The central part of the locomotive with the fore-part 2 accommodates the usual, normal locomotive driving unit with the locomotive electronics, while the movable fore-part 3 contains a cleaning unit 4 for cleaning the rails. In a housing 5 with removable cover 6, this cleaning unit comprises an electric cleaning motor 7, which is connected over a transmission 8 with an axle shaft 9, on which two rail-cleaning wheels 10 are fastened, which are driven in a rotating manner by the cleaning motor 7.

The cleaning wheels 10 comprise in each case a wheel flange disk 11 with a supporting ring 12 for a cleaning ring 13, as well as a holding disk 14, which can be braced with the help of an axle bolt 15 against the wheel flange disk 11, the cleaning ring 13 being clamped. By these means, the cleaning ring 13 can be exchanged very easily for a new one when it is worn down or contaminated more heavily. To increase the weight of the cleaning wheels on the rails, a loading weight can be provided. The cover 6 could also be constructed, for example, as such a loading weight. Under the removable cap 16 on the roof of the center part 17 of the locomotive, an adjusting knob for regulating the driving speed of the driving motor of the locomotive is disposed since, when the rail-cleaning locomotive is operating, the control console preferably is set to full driving voltage so that the cleaning motor 7 can produce the maximum output. Depending on the degree of contamination of the rails, the locomotive is run more or less slowly by means of the adjusting knob disposed below the cap 16, since a better cleaning effect is achieved if the locomotive is running more slowly. Conversely, however, for larger rail systems, one would like to conclude the cleaning procedure in a finite time; therefore the highest driving speed is selected, which will bring about the desired cleaning effect.

In the driver's cab in the center part of the locomotive, a function switch 24 with three positions, which can be activated from the outside and corresponds to three different operating states, is provided. In the first function position, the locomotive is switched off by being currentless, that is, the driving voltage, taken from the driving or running wheels 18, is not taken to the driving motor or to the cleaning motor. In the second function position of the function switch 24, only the cleaning motor is switched off, while voltage is taken to the driving motor and thus, when the control console is switched on, the locomotive runs on the rails without any cleaning action. Finally, in the third function position, the locomotive runs forwards with the cleaning fore-part in front and with the cleaning motor operating or backwards with trailing cleaning fore-part when the driving voltage is reversed at the rails. However, when the locomotive is running in the reverse direction, the cleaning motor is automatically switched off. The cleaning action thus takes place exclusively when the locomotive is moving forwards. This has the advantage that, due to the different mode of operation while driving forwards and backwards, dead-end rails, roundhouse rails, etc. can be cleaned and then left once again in the third function position.

On the roof of the center part 17 of the locomotive, flashing lights 19 can be recognized, which are coupled in their function with the operation of the cleaning motor 7. Only when the cleaning motor is running, that is, when the cleaning unit 4 is actually working, do these lights flash. It is therefore possible to see at once from the outside whether the cleaning unit is working or switched off when the locomotive is running on the rails.

Figure 3:
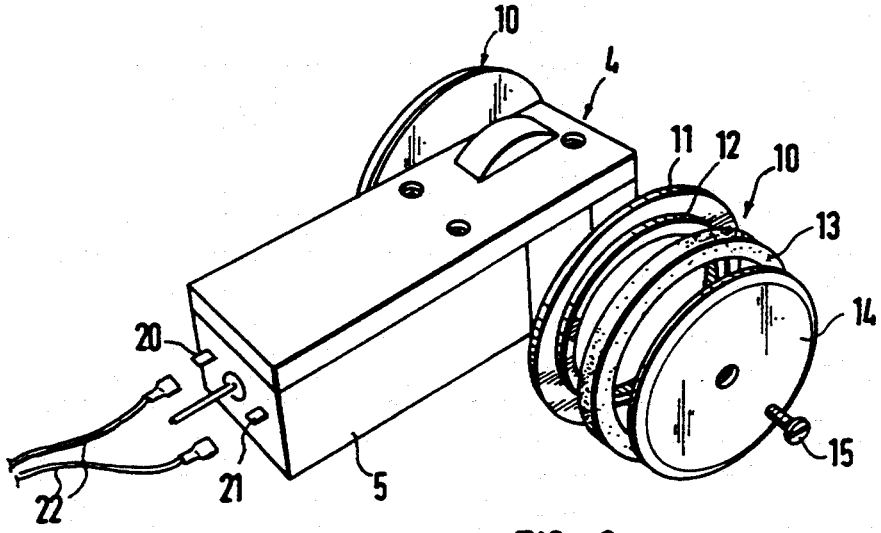
FIG. 3 shows a perspective view of the cleaning unit of the fore-part with the cleaning wheel disassembled, FIG. 4 also shows an enlarged view from below of the cleaning unit containing the fore-part containing the cleaning unit.
Figure 4:
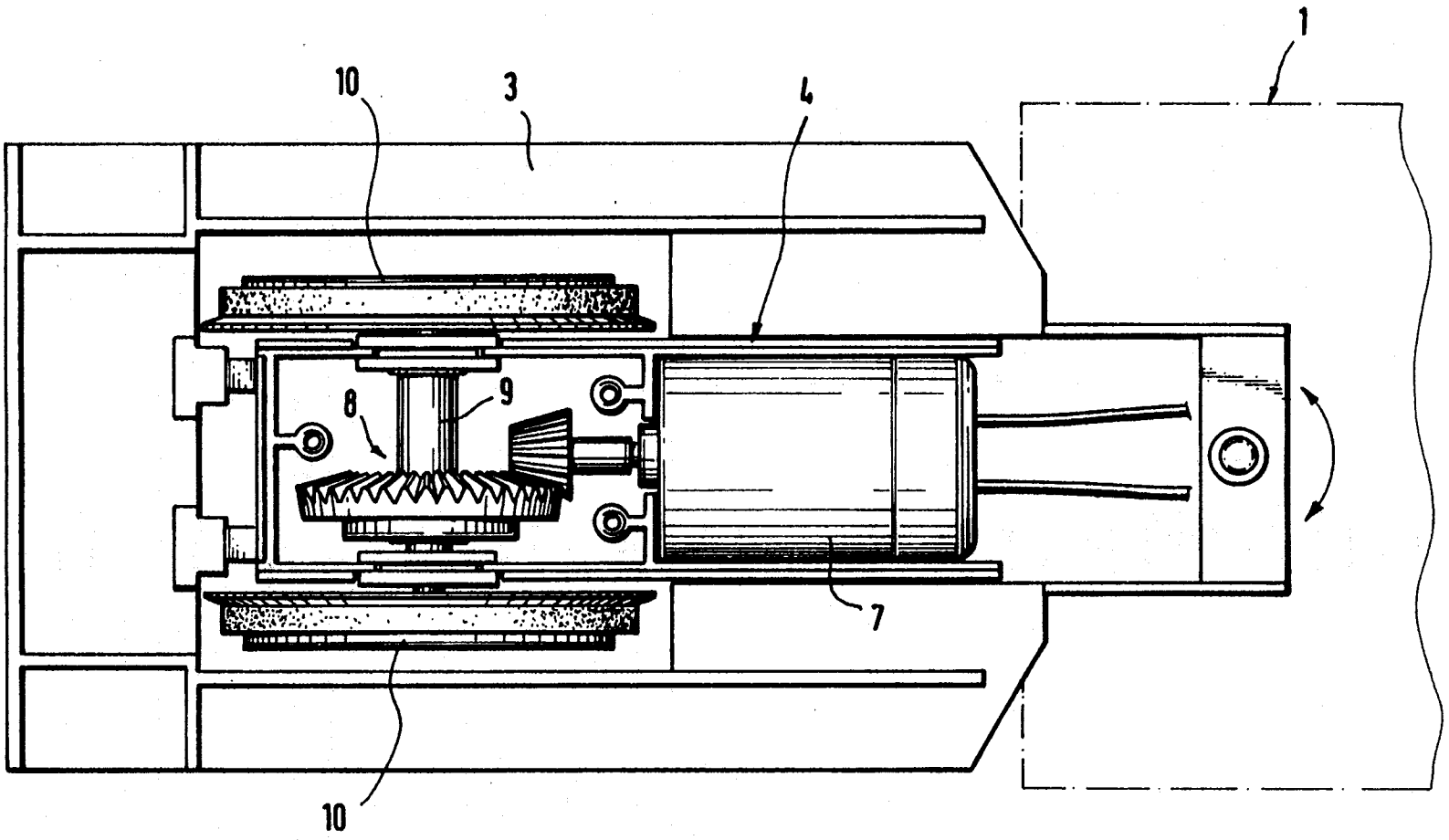

In FIG. 3, connecting contact studs 20 and 21 are passed through the housing 5 of the cleaning unit 4 in order to connect the cleaning motor 7 with the electronics of the locomotive over the indicated cable 22.

The cleaning unit 4 is additionally covered (encased) against dirt and grinding dust. Independently of this, the cleaning motor 7 itself should be encased completely dust-tight.

In order to achieve an optimum grinding action, the diameter of the cleaning wheels 10 should be larger than that of the driving wheels. The optimization of the grinding action can be improved further through the use of cleaning rings of different ranges of grain sizes depending on the degree of contamination of the rails.

Finally, it has also proven to be particularly advantageous to use multiple pole motors, particularly a 7-pole motor, and not only a simple motor with 3 poles as a cleaning motor.

Figure 5:
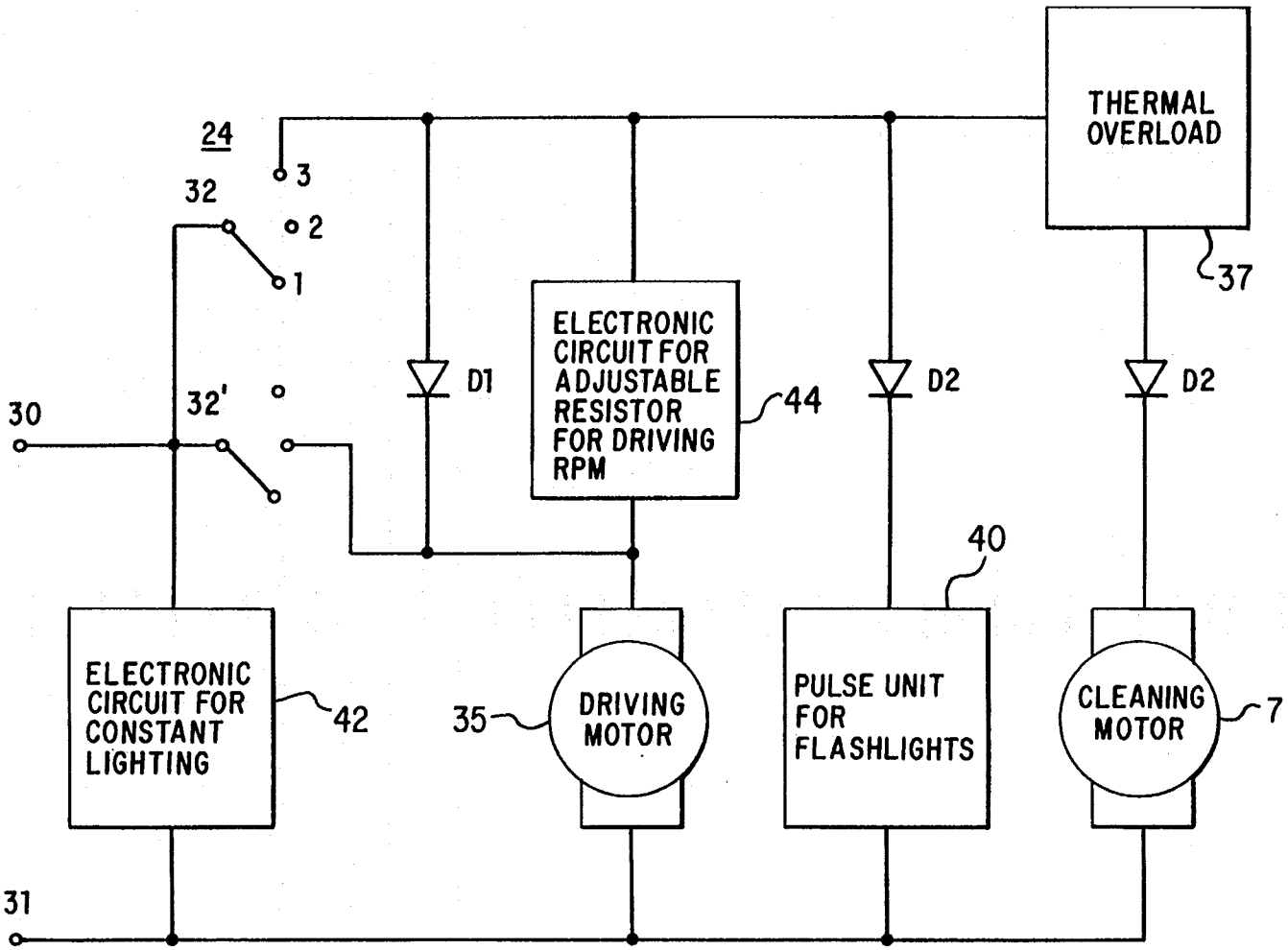
FIG. 5 is a circuit diagram of locomotive electronics which may be employed in the locomotive of the invention.

One example of electronic circuitry that may be employed in the locomotive of the invention is illustrated in FIG. 5, wherein suitable conventional track contacts 30, 31 are provided on the locomotive for application of current from the non-illustrated track to the locomotive. The contact 30 is connected to the movable arms 32, 32' of the switch 24. As discussed above, the switch 24 has three positions. The switch is illustrated in the OFF position, at which time neither the driving motor 35 nor the cleaning motor 7 is energized. At the central or driving position of the switch, only the driving motor 35 is energized. In the cleaning position of the switch, current is applied to the driving motor 35, as well as to the cleaning motor 7. This connection to the cleaning motor may include a thermal overload 37. Flashing lights may also be connected to be energized in the cleaning position of the switch 24, to signal that the cleaning operation is being performed. FIG. 5 also shows a pulse unit 40 for the flashing lights and also an electronic circuit 42 for constant lighting.

An electronic circuit 44 having a variable resistor is provided for controlling the speed of the driving motor. In FIG. 5, $D_1$ is operable to switch to non-regulated speed in a reverse direction. $D_2$ is operable to switch off the flashing lights while driving backwards and $D_3$ is operable to switch off the cleaning motor 7 while driving backwards.

While the invention has been disclosed with reference to a limited number of embodiments, it is apparent that the invention is not limited thereby. It is therefore intended, in the following claims, to cover each modification thereof that falls within the true spirit and scope of the invention.

What I claim:

1. A rail-cleaning locomotive for electric toy trains operable on rails, comprising:

a locomotive having a main locomotive unit and a cleaning unit, said cleaning unit being pivotal relative to said main locomotive unit, driving wheel means driven by driving motor means disposed on said main locomotive unit and operable to drive said locomotive along said rails, cleaning wheels on said cleaning unit for cleaning said rails as the locomotive passes over said rails, cleaning wheel motor means on said cleaning unit for driving said cleaning wheels, said cleaning wheel motor means being separate from said driving motor means;

supply means for supplying a constant full driving voltage to said cleaning wheel motor means and said driving motor means, and an adjusting knob for varying the voltage supplied to said driving motor means from said supply means while said constant full driving voltage is supplied to said cleaning wheel motor means.

2. A rail-cleaning locomotive according to claim 1 wherein said cleaning wheels have guide wheel flanges engageable with said rails.

3. A rail cleaning locomotive according to claim 1 wherein said cleaning unit is pivotal about a vertical axis relative to said main locomotive unit.

4. A rail cleaning locomotive according to claim 1 wherein said cleaning unit is pivotal about a horizontal axis relative to said main locomotive unit.

5. A rail cleaning locomotive according to claim 1 wherein said adjusting knob is manually operable.

6. A rail cleaning locomotive according to claim 1 wherein said adjusting knob is mounted on said main locomotive unit.

7. A rail cleaning locomotive according to claim 1 wherein said cleaning motor means rotates said cleaning wheels in a direction opposite to the direction of rotation of said driving wheel means.

8. A rail cleaning locomotive according to claim 1 wherein said cleaning unit comprises a loading weight means operable to increase the weight of the cleaning wheels on said rails.

9. A rail cleaning locomotive according to claim 1 wherein said cleaning motor means comprises a thermal overload switch to protect the cleaning motor means.

10. A rail cleaning locomotive according to claim 1 wherein said cleaning unit comprises flashing light means operable when said cleaning unit is operating.

11. A rail cleaning locomotive according to claim 1 further comprising electric connection means between said main locomotive unit and said cleaning unit.

12. A rail cleaning locomotive according to claim 1 wherein said cleaning motor means comprises a multi-pole motor.

13. A rail cleaning locomotive according to claim 12 wherein said multi-pole motor means is a 7-pole motor.

14. A rail cleaning locomotive according to claim 1 wherein said cleaning unit comprises a dust-tight enclosure means for said cleaning motor means.

15. A rail cleaning locomotive according to claim 1 wherein said cleaning unit comprises enclosure means disposed about said cleaning motor means and partially about said cleaning wheels.

16. A rail cleaning locomotive according to claim 1 wherein the diameter of said cleaning wheels is greater than the diameter of said driving wheel means.

17. A rail cleaning locomotive for electric toy trains operable on rails, comprising:

a locomotive having a main locomotive unit and a cleaning unit, said cleaning unit being pivotal relative to said main locomotive unit, driving wheel means driven by driving motor means disposed on said main locomotive unit and operable to drive said locomotive along said rails, cleaning wheels on said cleaning unit for cleaning said rails as the locomotive passes over said rails, cleaning wheel motor means on said cleaning unit for driving said cleaning wheels, said cleaning wheel motor means being separate from said driving motor means, and a function switch means having three positions including one position in which said driving motor means and said cleaning motor means are switched off, another position in which said driving motor means drives said driving wheel means while said cleaning motor means is switched off, and a further position in which said driving motor means drives said driving wheel means and said cleaning motor means drives said cleaning wheels.

18. A rail-cleaning locomotive according to claim 17 wherein said locomotive is operable in a forward direction in which said driving motor means drives said driving wheel means forward to move said locomotive in said forward direction with the cleaning unit leading the main locomotive unit in the direction of forward movement, said cleaning motor means driving said cleaning wheels when said function switch means is in said further position and said locomotive is being driven in said forward direction, said locomotive being operable in a reverse direction by reversing the direction of rotation of said driving motor means to thereby move said locomotive in a reverse direction in which the main locomotive unit leads said cleaning unit in the direction of reverse movement, said function switch means being operable to preclude driving of said cleaning motor means when said driving motor means moves said locomotive in said reverse direction and said function switch means is in said further position.

19. A rail cleaning locomotive for electric toy trains operable on rails, comprising:

a locomotive having a main locomotive unit and a cleaning unit, said cleaning unit being pivotal relative to said main locomotive unit, driving wheel means driven by driving motor means disposed on said main locomotive unit and operable to drive said locomotive along said rails, cleaning wheels on said cleaning unit for cleaning said rails as the locomotive passes over said rails, said cleaning wheels including a flange and a supporting ring, a cleaning ring disposed about said supporting ring, a holding ring juxtaposed to said cleaning ring, and a fastening means fastening said holding ring such that said cleaning ring is retained in position between said flange and said holding ring, and cleaning wheel motor means on said cleaning unit for driving said cleaning wheels, said cleaning wheel motor means being separate from said driving motor means.

* * * * *